US008809718B1

(12) United States Patent
Doak et al.

(10) Patent No.: US 8,809,718 B1
(45) Date of Patent: Aug. 19, 2014

(54) OPTICAL WIRE SORTING

(71) Applicant: MSS, Inc., Nashville, TN (US)

(72) Inventors: Arthur G. Doak, Nashville, TN (US); Mitchell Gregg Roe, Franklin, TN (US)

(73) Assignee: MSS, Inc., Nashville, TN (US)

( * ) Notice: Subject to any disclaimer, the term of this patent is extended or adjusted under 35 U.S.C. 154(b) by 0 days.

(21) Appl. No.: 13/721,393

(22) Filed: Dec. 20, 2012

(51) Int. Cl.
*B07C 5/00* (2006.01)

(52) U.S. Cl.
USPC ..... 209/576; 209/587; 209/598; 209/939

(58) Field of Classification Search
USPC ..... 209/517, 576, 577, 587, 598, 939; 250/227.2; 356/601; 382/141
See application file for complete search history.

(56) References Cited

U.S. PATENT DOCUMENTS

| | | | | |
|---|---|---|---|---|
| 4,738,175 | A * | 4/1988 | Little et al. | 83/76.8 |
| 5,253,765 | A | 10/1993 | Moorehead | |
| 5,409,119 | A * | 4/1995 | Rao Datari | 209/580 |
| 5,520,290 | A | 5/1996 | Kumar | |
| 5,791,497 | A * | 8/1998 | Campbell et al. | 209/577 |
| 5,829,600 | A | 11/1998 | Jordan et al. | |
| 6,124,560 | A | 9/2000 | Roos | |
| 6,506,991 | B1 * | 1/2003 | Eixelberger et al. | 209/581 |
| 6,545,240 | B2 | 4/2003 | Kumar | |
| 6,696,655 | B2 | 2/2004 | Harbeck et al. | |
| 6,805,245 | B2 | 10/2004 | Kenneway | |
| 6,914,678 | B1 | 7/2005 | Ulrichsen et al. | |
| 7,200,458 | B2 * | 4/2007 | Carman et al. | 700/117 |
| 7,222,738 | B1 | 5/2007 | Stockard | |
| 7,658,291 | B2 | 2/2010 | Valerio | |
| 7,674,994 | B1 | 3/2010 | Valerio | |
| 7,732,726 | B2 | 6/2010 | Valerio | |
| 7,786,401 | B2 | 8/2010 | Valerio | |
| 7,886,915 | B2 | 2/2011 | Shulman | |
| 8,131,020 | B2 | 3/2012 | Macgregor | |
| 2001/0031079 | A1 * | 10/2001 | Ryder | 382/141 |
| 2005/0040085 | A1 * | 2/2005 | Carman et al. | 209/576 |
| 2007/0187299 | A1 | 8/2007 | Valerio | |
| 2009/0251536 | A1 | 10/2009 | Sinram | |
| 2010/0282646 | A1 | 11/2010 | Looy | |
| 2011/0297590 | A1 | 12/2011 | Ackley | |
| 2012/0074047 | A1 | 3/2012 | Deefholts | |

OTHER PUBLICATIONS

Exhibit A: Wikipedia printout on "Gabor filter" (4 pages) (admitted to be prior art).
Exhibit B: MSS Brochure on "L-VIS" (2 pages) (undated but admitted to be prior art).
Exhibit C: TiTech Brochure "Application Report—Wire Recovery" (7 pages) (undated but admitted to be prior art).
Exhibit D: TiTech Brochure "TiTech Combisense" (7 pages) (undated but admitted to be prior art).
Exhibit E: Best Sorting website printout (2 pages) (undated but admitted to be prior art).
Exhibit F: SGM Magnetics website printout (3 pages) (undated but admitted to be prior art).

* cited by examiner

*Primary Examiner* — David H Bollinger
(74) *Attorney, Agent, or Firm* — Waddey & Patterson, P.C.; Lucian Wayne Beavers

(57) ABSTRACT

A wire sorting system identifies and sorts wire from mixed electronic waste solely by the shape of the wire. A digital image of a stream of articles is created, and the image data may be processed using a Gabor filter technique to identify elongated narrow objects such as wire.

31 Claims, 17 Drawing Sheets

OPTICAL WIRE SORTING

BACKGROUND OF THE INVENTION

1. Field of the Invention

The present invention relates generally to optical sorting systems, and more particularly, but not by way of limitation, to systems for sorting wire or other elongated narrow articles from a stream of mixed articles.

2. Description of the Prior Art

In the field of automated sorting of recycled waste materials, one class of materials which is becoming increasingly important is electronic waste. Electronic waste includes various electronic devices such as computers, printers, cell phones and the like which have been shredded into randomly sized articles, which then must be sorted.

One very valuable and desirable component of electronic waste is the copper wire in the waste.

Prior art approaches to the sorting of wire from mixed waste materials has typically identified the wire either by the color of the material, i.e. by looking for the red copper wire, or by the material composition of the article, for example identifying wire with a metal sensor, such as an inductance sensor or an eddy current sensor.

There is a continuing need for improved methods for the efficient sorting of wire from a stream of articles.

SUMMARY OF THE INVENTION

In one aspect a method of sorting elongated narrow articles from a stream of articles comprises:

(a) receiving at an optical detector electromagnetic energy from the stream of articles as the articles move through an inspection zone and generating image data representative of the stream of articles;

(b) identifying from the image data locations of articles having an elongated narrow shape solely by shape without any reference to color or material composition of the articles; and (c) separating the articles identified in step (b) from the stream of articles.

In another aspect a system for identifying elongated narrow articles in a stream of items moving along a path through an inspection zone, and for separating the elongated narrow items from the stream of items, includes an array of ejectors arranged transversely across the path. The ejectors are constructed to eject selected items from the stream of items. A detector is arranged to scan the inspection zone transversely across the path. A controller is operably connected to the detector to receive input signals from the detector. The controller is operably connected to the array of ejectors to send control signals to the ejectors. The controller is configured to identify by shape of the items any elongated narrow items having a maximum width and having a length greater than the maximum width, the maximum width being no greater than about 0.300 inch.

In any of the embodiments above, the elongated narrow articles to be sorted may include wire.

In any of the embodiments above, the optical detector may include a line scan camera.

In any of the embodiments above, the identification of the elongated narrow shaped articles may be performed using a Gabor filter.

In any of the embodiments above, the identification of the elongated narrow articles may include defining a plurality of image areas within an image of the stream of articles, and comparing each of the image areas to a rotating sequence of filter kernels, each filter kernel including a plurality of parallel bars, each filter kernel being rotated relative to an adjacent filter kernel in the sequence.

In any of the embodiments above, each of the image areas may include a plurality of adjacent lines of image data recorded by the optical detector.

In any of the embodiments above, each of the image areas may include a plurality of pixels, and the identification of the elongated narrow shaped articles may include examining each pixel of the plurality of pixels in an image area and determining for each pixel whether there is a positive indication that an article having an elongated narrow shape lies across the pixel.

In any of the embodiments above, the separation of the articles from the stream of articles may include deflecting articles from the stream of articles using an air jet having a jet resolution area, and determining whether to fire each jet based upon a density of positively indicated pixels within the jet resolution area.

In any of the embodiments above, each of the image areas may have a maximum dimension in a range of from about ⅛ inch to about ½ inch.

In any of the embodiments above, each of the image areas may have a maximum dimension no greater than about ½ inch.

In any of the embodiments above, each of the image areas may be square.

In any of the embodiments above, the elongated narrow articles may have a narrow dimension in a range of from about 0.010 inch to about 0.300 inch.

In any of the embodiments above, the identification of the elongated narrow articles may include identifying elongated narrow articles having a maximum narrow dimension of no greater than about 0.300 inch.

In another aspect a method of sorting articles by shape from a stream of articles comprises:

(a) receiving at an optical detector electromagnetic energy from the stream of articles as the articles move through an inspection zone and generating image data representative of the stream of articles;

(b) identifying from the image data by shape of the articles locations of articles having a selected shape; and (c) separating the articles identified in step (b) from the stream of articles The method of selecting articles by shape may be based upon elongated narrow shapes, 90 degree corner shapes, circular shapes, or other shapes.

Numerous objects features and advantages of the present invention will be readily apparent to those skilled in the art upon a reading of the following disclosure when taken in conjunction with the accompanying drawings.

DETAILED DESCRIPTION

Figure 1:
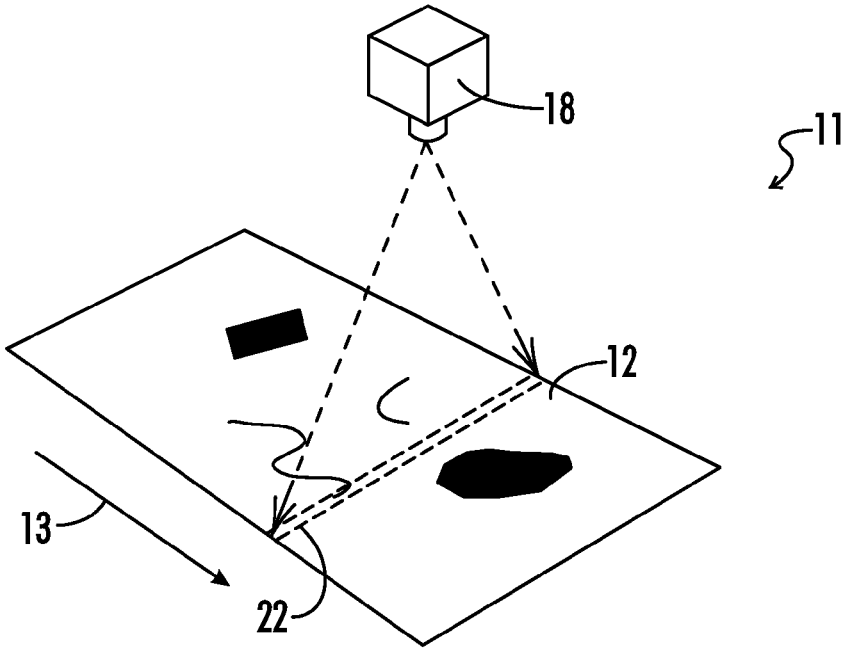
FIG. 1 is a schematic perspective view of a portion of a wire sorting system.
Figure 2:
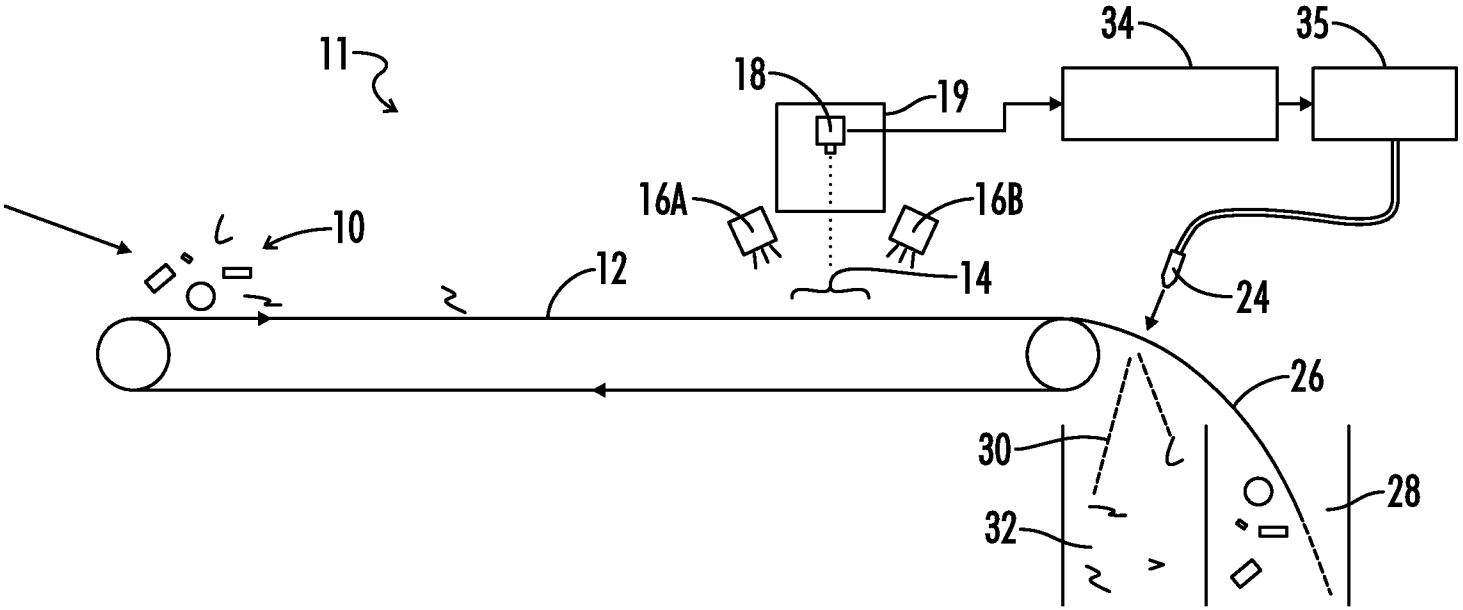
FIG. 2 is a schematic side elevation view of the wire sorting system of FIG. 1.
Figure 3:
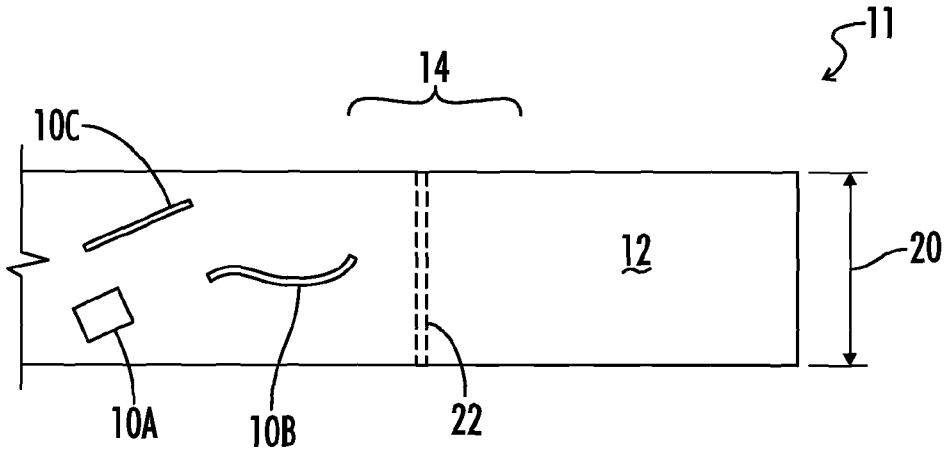
FIG. 3 is a schematic plan view of the wire sorting system of FIG. 1.

As schematically shown in FIGS. 1, 2 and 3, a system 11 is provided for identifying elongated narrow items such as 10B or 10C in a stream of items 10 moving along a path defined by conveyor belt 12 through an inspection zone 14. The system 11 is configured for separating the elongated narrow items, and particularly wire, from other non-elongated items such as 10A in the stream of items 10.

Light sources 16A and 16B shine on the objects 10 in the inspection zone 14. An optical detector 18 is arranged to scan the inspection zone 14 transversely across the path of the articles 10.

In one embodiment, the optical detector 18 may be a line scan camera 18 which gathers data across a width 20 of the conveyor belt 12. When using a line scan camera 18 the data is gathered across a very narrow scan line 22 within the inspection zone 14. As will be understood by those skilled in the art, the line scan camera 18 gathers data one narrow line at a time, with the line 22 having a width parallel to the length of the belt equal to the resolution of the line scan camera, which in one example may be approximately 0.025 inch.

In general, the path of the articles 10 includes the width 20 of the conveyor 12 and the length of the conveyor 12, moving in the direction 13 indicated by the arrow 13 in FIG. 1. The path may also include the flight of the articles in a trajectory off the end of the belt 12.

As best seen in FIG. 2, the articles 10 are launched off the end of the belt 12 along a first trajectory 26 toward a first receptacle 28. An array of ejectors 24 is arranged transversely across the path, and the ejectors 24 are arranged to eject items from the first trajectory 26 to a second trajectory 30 into a second receptacle 32. The ejectors 24 are preferably air jet ejectors.

Figure 4:
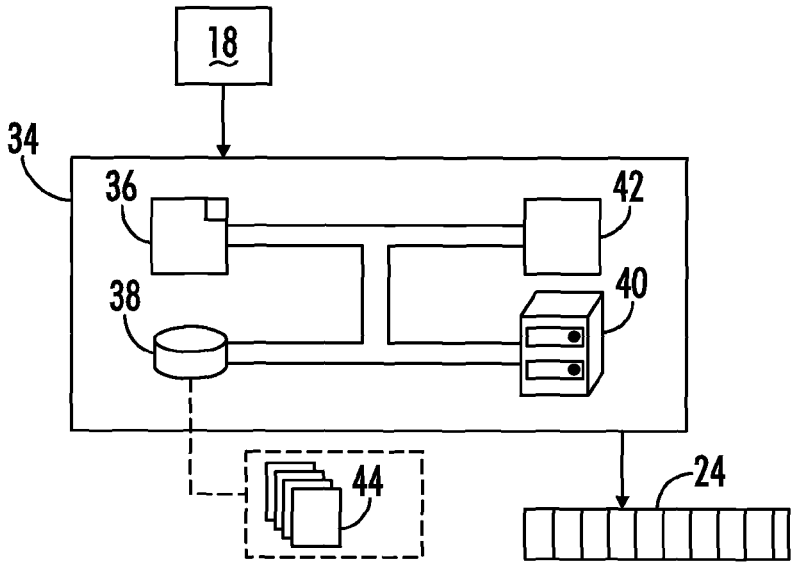
FIG. 4 is a schematic illustration of the control system of the wire sorting system of FIG. 1.

As best seen in FIG. 4, the system 11 further includes a controller 34 operably connected to the detector 18 to receive input signals from the detector 18. The controller 34 is also operably connected to the array of ejectors 24 via an air solenoid interface 35 to send control signals to the ejectors 24. As will be further described below, the controller 34 is configured to identify by the shape of the items 10 any elongated narrow items having a maximum width and having a length greater than the maximum width, wherein the maximum width in one embodiment may be no greater than about 0.300 inch. In another embodiment, the maximum width may be no greater than about 0.250 inch. In another embodiment, the width of the elongated narrow articles may be in a range of from about 0.010 inch to about 0.300 inch.

The controller 34 further includes a processor 36, a computer-readable memory medium 38, a database 40 and an I/O platform or module 42 which may typically include a user interface generated by the program instructions in accordance with methods or steps described in greater detail below.

The term "computer-readable memory medium" as used herein may refer to any non-transitory medium 38 alone or as one of a plurality of non-transitory memory media 38 within which is embodied a computer program product 44 that includes processor-executable software, instructions or program modules which upon execution may provide data or otherwise cause a computer system to implement subject matter or otherwise operate in a specific manner as further defined herein. It may further be understood that more than one type of memory media may be used in combination to conduct processor-executable software, instructions or program modules from a first memory medium upon which the software, instructions or program modules initially reside to a processor for execution.

"Memory media" as generally used herein may further include without limitation transmission media and/or storage media. "Storage media" may refer in an equivalent manner to volatile and non-volatile, removable and non-removable media, including at least dynamic memory, application specific integrated circuits (ASIC), chip memory devices, optical or magnetic disk memory devices, flash memory devices, or any other medium which may be used to stored data in a processor-accessible manner, and may unless otherwise stated either reside on a single computing platform or be distributed across a plurality of such platforms. "Transmission media" may include any tangible media effective to permit processor-executable software, instructions or program modules residing on the media to be read and executed by a processor, including without limitation wire, cable, fiber-optic and wireless media such as is known in the art.

The term "processor" as used herein may refer to at least general-purpose or specific-purpose processing devices and/or logic as may be understood by one of skill in the art, including but not limited to single- or multithreading processors, central processors, parent processors, graphical processors, media processors, and the like.

The controller 34 receives data from the optical detector 18 and processes that data to identify elongated narrow items, such as wire, and then sends the appropriate instructions to the array of ejectors 24 to deflect selected articles from the primary trajectory 26 to the second trajectory 30.

Processing of Image Data to Identify Elongated Narrow Articles

The following describes one example of a technique for identifying elongated narrow objects from the image data gathered by optical detector 18, when that optical detector 18 is a line scan camera. As is further discussed below, other types of detectors may be utilized to generate image data, and the techniques used for processing that data may vary depending upon the type of data generated.

When utilizing a line scan camera 18 to detect the light or electromagnetic energy reflected or emitted from the belt 12 and from articles 10 on the belt 12, the line scan camera 18 views one narrow line 22 at a time extending across the width 20 of the belt 12 as schematically illustrated in FIG. 3. That line 22 will have a width equal to the resolution of the line scan camera, which for a typical line scan camera may for example be approximately 0.025 inch. The data collected for each scan of the line scan camera across the width 20 of the belt is broken into a series of pixels, each pixel representing approximately a square area having sides equal to the camera resolution 0.025 inch. The line scan camera may actually view a circular spot contained in the square pixel. Thus, for example, for a 48 inch wide belt 12, one scan of the line scan camera is broken into 1,920 pixels making up the scan line 22 across the width of the belt. Although a line scan camera views and generates the entire line 22 at one instant in time, the image data generated by the line scan camera is read out from the camera as a series of digital data representative of the image detected at each pixel. For example, the data for each pixel may be represented by a 1 or a 0, with 1 indicating the presence of an article at the pixel, and with 0 indicating the absence of an article at the pixel.

The controller 34 is configured such that one line of image data is created each time the belt 12 advances by the 0.025 inch width of the line scan 22. Thus, a two-dimensional image of the articles passing through the inspection zone will be made up of a plurality of adjacent lines of image data recorded by the line scan camera 18.

Figure 5A:
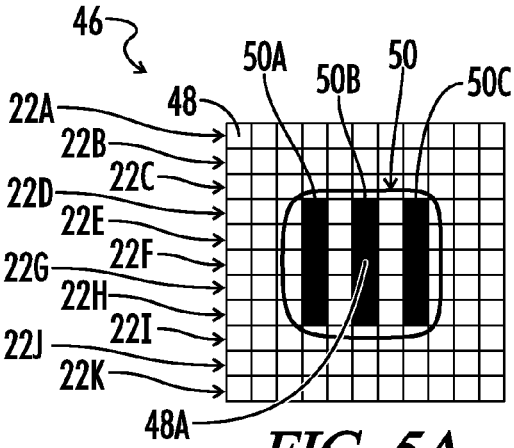
FIGS. 5A-5H comprise a sequential series of schematic views showing the application of a Gabor filter kernel to an image area in a plurality of sequential orientations of the filter kernel.
Figure 5B:
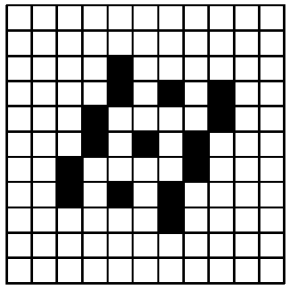

In FIG. 5A, one portion of an image of the stream of articles is represented and may be generally referred to as an image area 46. In FIG. 5A, each horizontal line of squares such as 22A, 22B, etc. corresponds to the data gathered by one scan of the line scan camera 18 across the width 20 of the belt 12. Each of the squares such as 48 is representative of one pixel of data generated by the line scan camera 18. Thus, FIG. 5A represents a portion of the combined data for a series of scans such as 22A-22K.

The technique described herein provides a data processing technique which enables the identification from the image data of the locations of articles having elongated narrow shapes, solely by the shape of the article without any reference to other characteristics such as color or material composition of the articles. One technique by which this can be accomplished is the use of a Gabor filter to identify the presence of articles having an elongated narrow shape. This technique is schematically illustrated in FIGS. 5A-5H which represents the analysis of one pixel located within one image area. A rotating sequence of filter kernels is compared to the image area. Each filter kernel includes a plurality of parallel bars. Each filter kernel is rotated relative to an adjacent filter kernel in the sequence.

The computer program 44 stored in the memory 38 defines a kernel which is to be shape matched against the image data. As seen in FIG. 5A, a kernel 50 is represented by three bars 50A, 50B and 50C. In the example shown, a centermost pixel 48A of the kernel 50 will be analyzed to determine whether an elongated narrow article lies across the pixel 48A. The data corresponding to each of the individual pixels such as 48A will ultimately be analyzed, and the computer program looks for an article which is aligned with the middle bar 50B of the kernel and which is not present in the side bars 50A and 50C of the kernel 50.

It is necessary to look for the elongated object matching the presence of the bar 50B in all possible angular orientations. Thus, the FIGS. 5A-5H show the kernel 50 in eight different orientations, each rotated 22.5 degrees relative to the prior orientation, so that an elongated object lying in approximately any of those eight orientations can be detected.

A preferred image area size is made up of an 8×8 pixel arrangement so that there are 64 bits of information representative of either the positive or negative result of the test. That information is compared to the mask and the result is a 1 if there is a perfect match or a 0 otherwise so that for each test, the center pixel of interest is assigned a 1 for a positive test or a 0 for a negative test.

In the particular example shown, the kernel 50 occupies a 5×5 square of pixels 48. A 7/7 kernel may also be used. Either a 5×5 kernel or a 7×7 kernel will fit within an 8×8 pixel image area so that the digital information for each pixel comprises a 64 bit word of computer data representative of the presence or absence of an elongated article at pixel 48A aligned with the middle bar 50B of kernel 50. The kernel mask typically will have an odd number of pixels along each dimension so that there is a true center pixel of the mask.

The computer programming 44 includes control logic configured to define a plurality of image areas making up an image of the stream of articles, and to compare each of the image areas to the rotating sequence of filter kernels of the Gabor filter. The size of each of the image areas will depend upon the resolution of the optical detector, and the number of lines of data utilized to define the area. For an 8×8 pixel image area, with a pixel size of 0.025 inch, the image area will be a square having sides of 0.200 inch. A typical size for such an image area may be in the range of from about ⅛ inch to about ½ inch square. Alternatively, the image areas could be described as having a maximum dimension no greater than about ½ inch. Each of the image areas may be a square image area.

As the process moves from one pixel of interest to the next pixel of interest, the image area associated with the pixel of interest will change, and image areas used to analyze adjacent pixels may overlap.

It is desirable to reduce the computer processing time for the wire detection algorithm as much a possible because of the large data rate typically required for a practical sorting machine. A 48 inch wide unit with a belt speed of 100 inches per second and a resolution of 1920 pixels at 48 inches and a scan rate of 4 KHZ produces pixel data at over 8 million pixels per second. Each pixel must be evaluated by testing a 16 kernel set for a match. Each kernel contains 49 pixel positions in a roughly square pattern.

In order to process the data as quickly as possible it is desirable to work in the native data format of the processing computer. In this case a 64 bit binary processor may be employed. Each time a pixel is evaluated using the kernel set, it is advantageous if the data required for that pixel to be evaluated is readily available. If there is a need to index through the image relative to the target pixel and gather data, extra time will be required. Instead, the present system may use a repacking method so that all data for a pixel evaluation is contained within one 64 bit datum in computer memory. In this way the processing for that pixel location is minimized. Since the operation to evaluate the pixel and kernel is binary, the operation is reduced to a small set of Boolean operations on a single binary word. This greatly reduces processing time.

Figure 28:
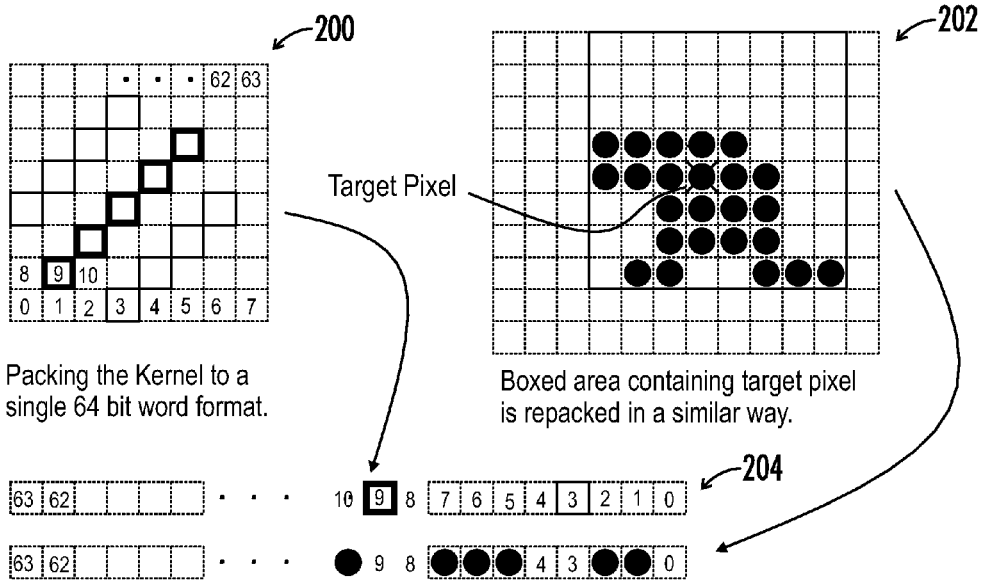
FIG. 28 is a schematic illustration of the manner in which the filter kernel and the image data are both defined as 64 bit data which can be readily compared.

As noted, the kernels used are of a size that fits in an 8×8 square. Any one kernel orientation may then be represented as one 64 bit word as schematically shown at 200 in FIG. 28. Similarly, the object image in the area around the target pixel may be represented as one 64 bit word as shown schematically at 202 in FIG. 28. The processing may then be done as a series of Boolean operations where one instruction operation processes the entire kernel as shown schematically at 204 in FIG. 28.

The algorithm utilized to identify elongated objects such as 10B or 10C (see FIG. 3) on the conveyor belt places a mask of the kernel 50 in each of the eight different orientations centered on each pixel to be examined, to detect an elongated object lying across that pixel. This mask representative of kernel 50 is effectively moved across the conveyor belt and examined in each of its orientations at each pixel 48 to identify articles such as 10B or 10C. The method just described identifies elongated articles such as 10B or 10C solely by processing the images acquired by the line scan camera 18.

The use of such a Gabor filter technique to identify elongated narrow articles in a stream of articles and to subsequently eject those articles from the stream is schematically illustrated in the sequential series of illustrations of FIGS. 6-18.

Figure 6:
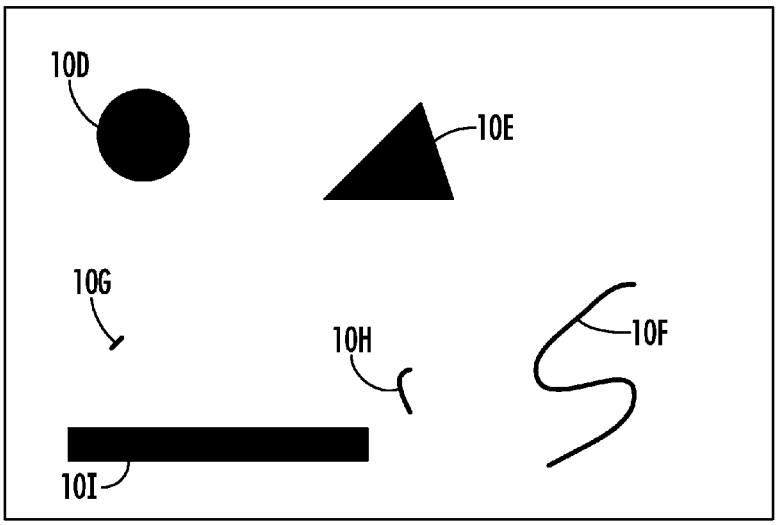
FIG. 6 is a schematic plan view of raw image data generated by the line scan camera.

FIG. 6 represents an area of the raw image data from the line scan camera 18 viewing the articles 10 on the belt 12. In the example shown there is a circular article 10D, a triangular article 10E, a relatively small diameter long S-shape article 10F which is representative of a long piece of very small diameter wire, two very short pieces of wire 10G and 10H, and one relatively large elongated narrow article 10I which is representative of a length of heavy gauge wire or perhaps a wire cable or wire bundle.

Figure 7:
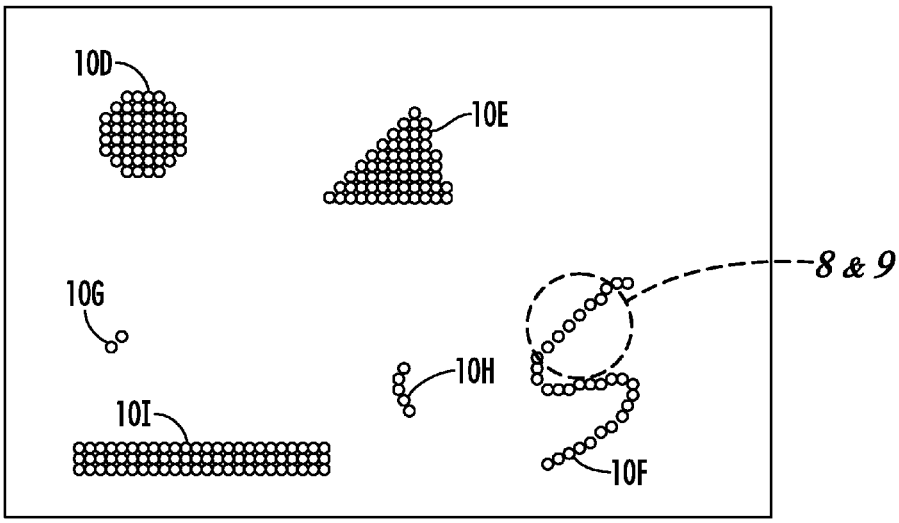
FIG. 7 is a schematic plan view of the image data of FIG. 6 having been processed to produce an object image.

In FIG. 7, the raw image has been processed to produce an object image. Typically, the reflectivity signal received by line scan camera 18 is compared to a threshold value for each pixel to produce a pixel image showing the pixels for which reflectivity is above or different from the background level reflectivity of the belt 12. This object image represented in FIG. 7 is binary in nature. A given pixel in the image is either an object or not an object. No other information is included. As previously noted the resolution of the image may for example be 0.025 inch in both directions for each pixel. As is also visually shown in FIG. 7, each of the pixels viewed by the line scan camera 18 may actually be a circular area rather than a square area.

It will be understood that the degree of difference in reflectivity detected for a given pixel necessary to create a positive reading is based on the system design, and it is not necessary that the entire pixel be covered by the object. Thus the minimum detectable width will be some value less than the pixel width. A practical detection limit may be about ⅓ of the pixel width. For example, using a pixel width of 0.025 inch, a wire diameter of 0.010 inch lying across the pixel will surpass the threshold and create a positive reading. A number 30AWG wire has such a 0.010 inch diameter.

The smallest wire detectable is a width wide enough to cause the reflectivity of one pixel which contains a segment of the wire to be high enough to cause the pixel to be classified as an object as distinguished from the background. It is estimated that the practical size limit is about ⅓ of the pixel size. A round number of 0.010 inch is used which is the width of No. 30AWG wire, which is the smallest common wire size expected to be detected with a 0.025 inch pixel resolution.

The largest wire detectable is that size which may be fitted into the kernel without covering an exclusion zone on either side. Different kernels are used as shown in FIGS. 5A-H, 23 A-D and 24 A-D. The smallest kernel shown in FIGS. 5A-H will accommodate a 3 pixel wide wire. The largest kernel shown in FIGS. 24 A-D will accommodate a 6 pixel wide wire.

Even larger wire sizes are accommodated by rescaling the input image by ½ and then reprocessing it. This method enables 10 pixel wide wires to be detected by the kernel set. This typically corresponds to 10×0.025 inch or 0.250 inch. The resulting detection range is then from about 0.010 inch to about 0.025 inch wire diameter. Typical wire types included in this range include:

No. 30AWG to No. 10 or larger magnet wire;

No. 28AWG to No. 10 insulated wire; and

Jacketed multi-conductor cables up to 0.250 inch diameter.

Figure 8:
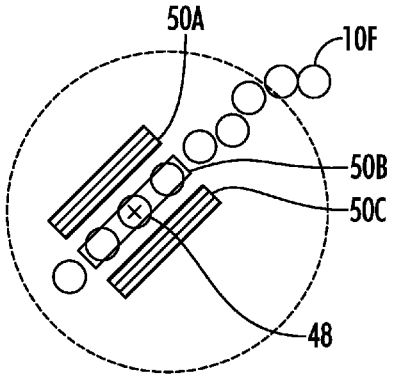
FIG. 8 is an enlarged view of the circled area of FIG. 7 showing a kernel orientation which is satisfied to indicate the presence of an elongated narrow object at the center of the kernel.
Figure 9:
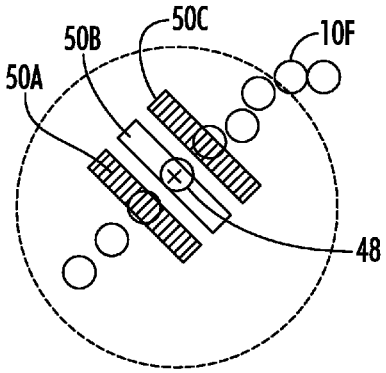
FIG. 9 shows the enlarged circled area of FIG. 7 again, this time with a kernel orientation which is not satisfied, thus indicating the absence of an elongated narrow article in the orientation tested.

In FIG. 7, a circular area is indicated in the dashed circle, which is shown in enlarged view in FIGS. 8 and 9.

Figure 5C:
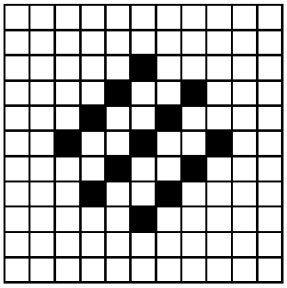
Figure 5D:
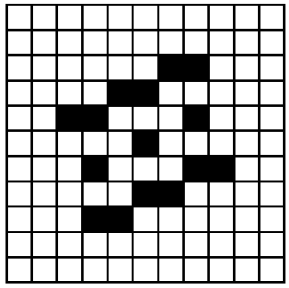
Figure 5E:
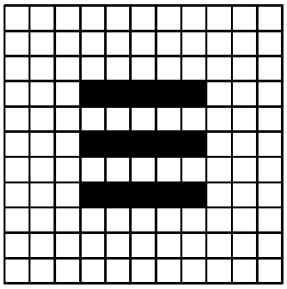
Figure 5F:
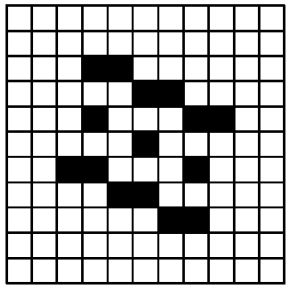
Figure 5G:
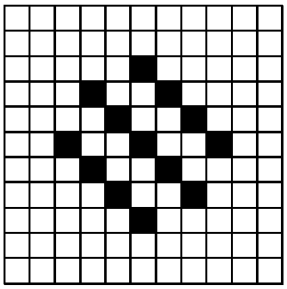
Figure 5H:
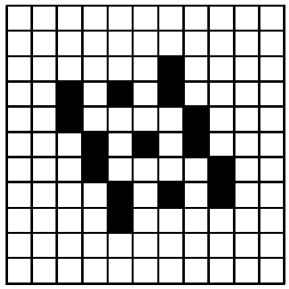

In FIG. 8, a representation is shown of the kernel 50 of the Gabor filter oriented at an angle of 45 degrees from left to right, comparable to FIG. 5C, which shows that the kernel 50 is satisfied in this orientation because the object 10F aligns with the middle bar 50B of the kernel and is not present in either of the side bars 50A or 50C.

Similarly, FIG. 9 shows an orientation of the kernel wherein the conditions for detection of an elongated article are not satisfied.

The wire detection kernel 50 requires the presence of object pixels in the middle row 50B, but also requires the absence of any objects on either side of the row of pixels in rows 50A or 50C. This kernel pattern is applied at numerous sequential orientations so wires or segments of wires lying in various orientations can be detected. Each pixel of the image data is tested, typically in a raster pattern. By raster pattern it is meant that one pixel is examined in all orientations of the kernel, then, the next adjacent pixel is examined in all orientations of the kernel, etc. across the entire width 20 of the belt 12.

In order to determine that an elongated article lies across the location of any given pixel 48, it is only necessary that the kernel 50 is satisfied in one orientation of the kernel. Thus for the analysis of the pixel 48 at the center of the kernel 50 in FIGS. 8 and 9, that pixel would test positive to indicate that there is an elongated article lying across the location of the pixel 48, because the kernel tested positive in one orientation, as schematically illustrated in FIG. 8.

Figure 10:
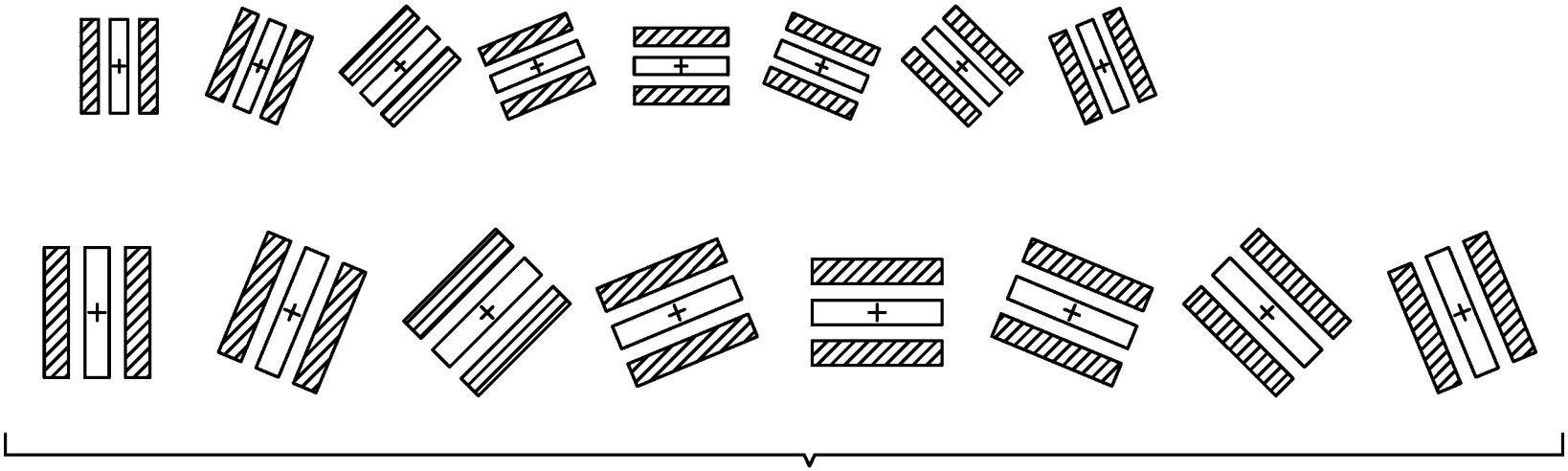
FIG. 10 comprises an upper row showing 8 sequential orientations of a small kernel set, and a lower row showing 8 sequential orientations of a larger kernel set, representative of the 16 examinations which would be made for each pixel of an image area to determine the presence of an elongated narrow article overlying the pixel. The smaller kernels test for smaller width articles or smaller width wire. The larger kernels test for larger width articles or larger width wire.

FIG. 10 schematically illustrates the manner in which each pixel 48 is tested. For each pixel 48, sixteen kernels are compared to the image area around that pixel. First, as schematically illustrated in the upper row of FIG. 10, a set of smaller kernels are compared to the image data for the image area. Then, as is further described below and is schematically illustrated in the bottom row of FIG. 10, a larger set of kernels are compared to the area image data, which allows larger widths of elongated narrow articles to be detected.

Figure 11:
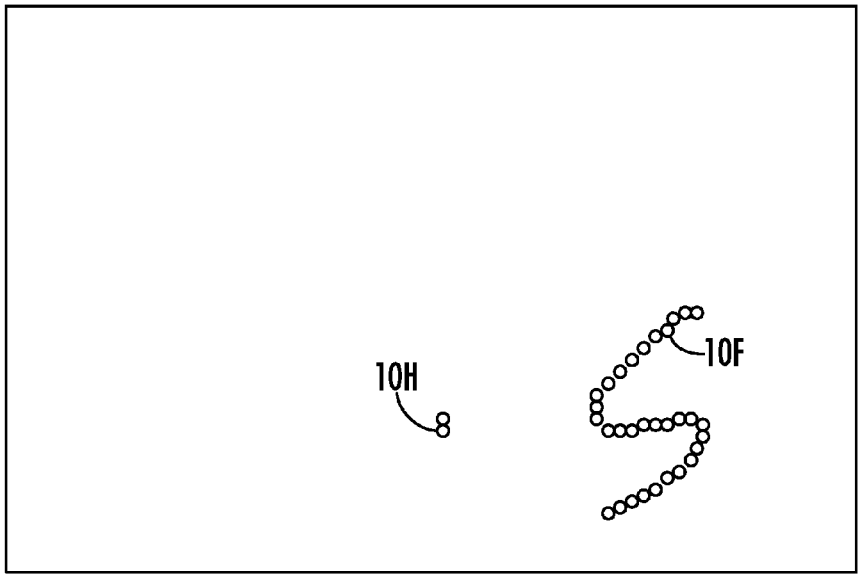
FIG. 11 is a schematic plan view showing the image data generated by the application of the smaller set of filter kernels.

From the smaller kernel analysis schematically illustrated in the top row of FIG. 10, a new image is generated as schematically shown in FIG. 11 which shows locations where the filter kernel set produced a positive result in at least one kernel orientation test. This application of the smaller kernels has detected the presence of the elongated narrow article 10F and the elongated narrow article 10H. It is noted that the larger elongated narrow article 10I has not been detected at this stage.

Figure 12:
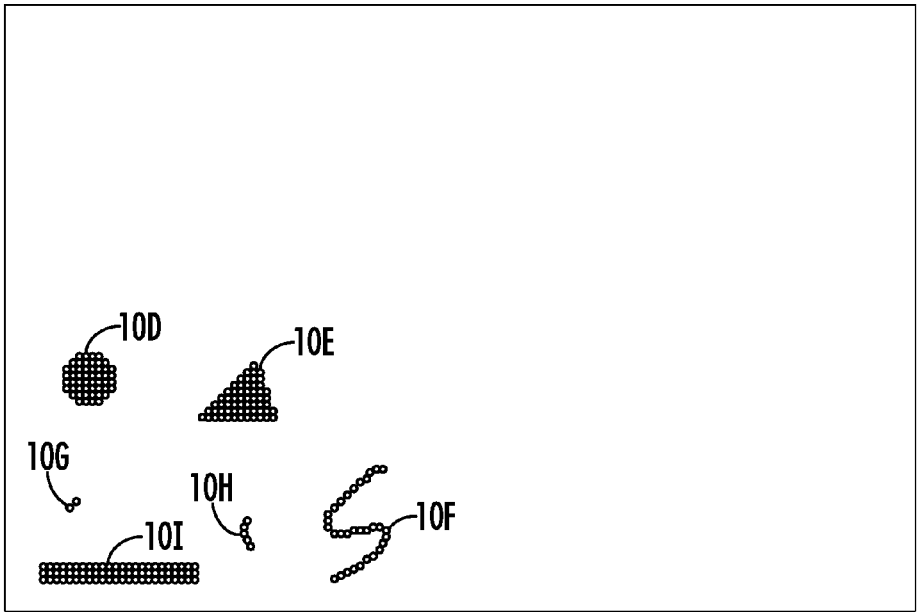
FIG. 12 shows a rescaled object image reduced in size by a factor of 2.

Then as schematically represented in FIG. 12, the object image is rescaled to reduce its size by an approximate factor of typically 2.

Figure 13:
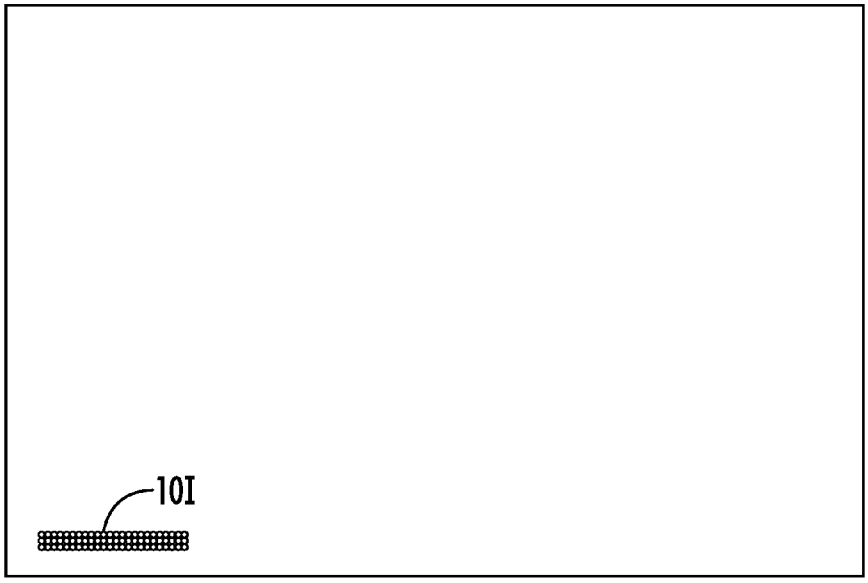
FIG. 13 shows the image detection data from the application of the larger set of filter kernels to the rescaled image data.

Then the larger set of wire detection kernels schematically represented by the lower row in FIG. 10 is applied to the rescaled image of FIG. 12, resulting in the image of FIG. 13 in which the larger dimensioned elongated narrow article 10I has been detected.

Figure 14:
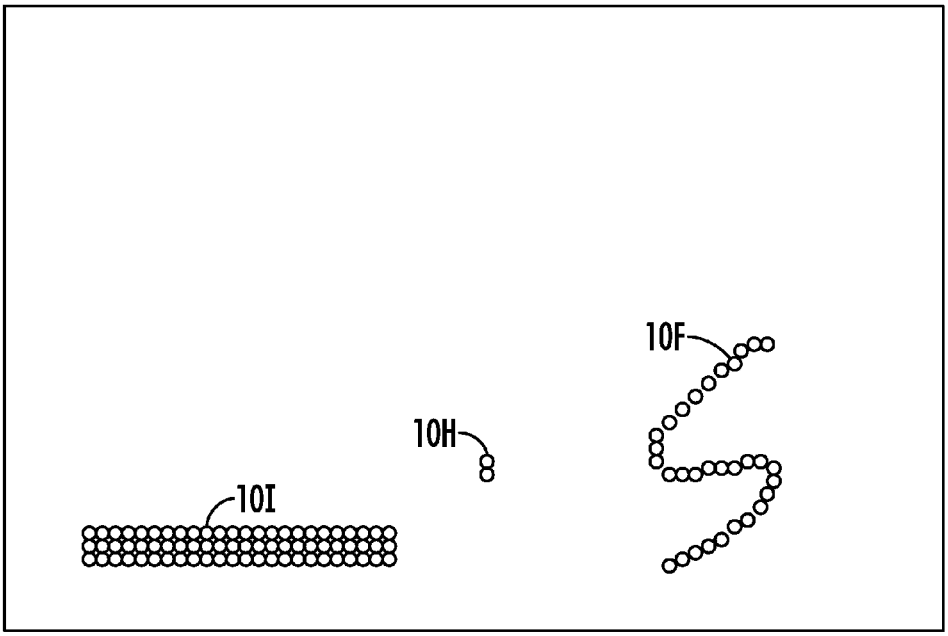
FIG. 14 is a schematic plan view showing the image data from FIG. 13 having been added back to the image data from FIG. 11.

Then as schematically represented in FIG. 14, the new data detected as shown in FIG. 13 is added back to the previous data of FIG. 11 resulting in the image of FIG. 14 showing all pixel locations where the kernel algorithm has identified a positive result for the presence of an elongated narrow article.

Figure 15:
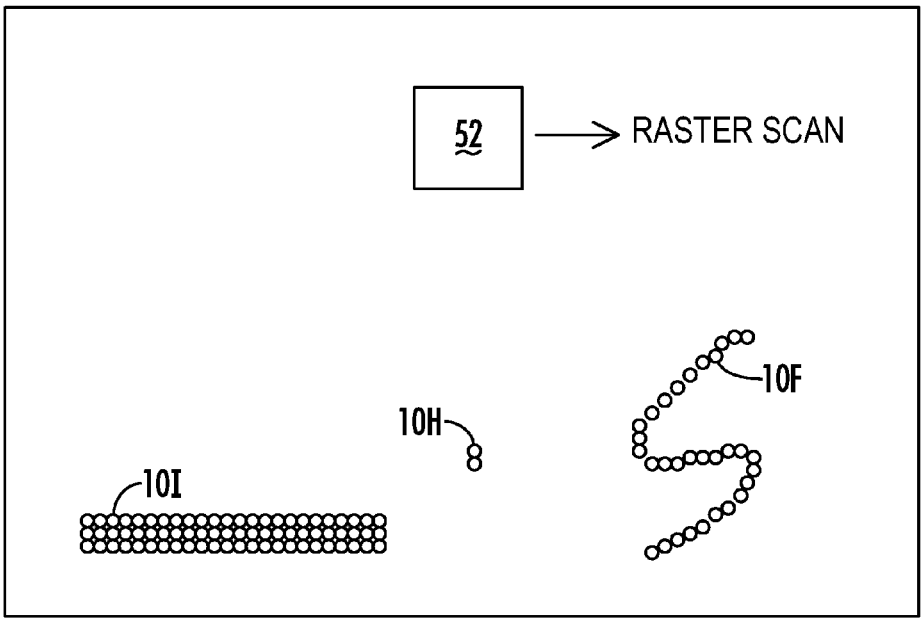
FIG. 15 schematically illustrates the application of a low pass filter to remove spurious data.

Next, as schematically illustrated in FIG. 15 the raw image data of FIG. 14 is filtered to remove spurious pixels. A conventional two-dimensional low pass filter is used. For example, a 5×5 filter area 52 may be passed across the image data in a raster scan manner. The computer program 44 may for example apply a logic filter which asks whether in the 5×5 area represented by filter area 52 there are less than four pixels which tested positive for the presence of an elongated narrow article. This will remove any single pixels which might have been identified or very small elongated articles such as 10H.

Figure 16:
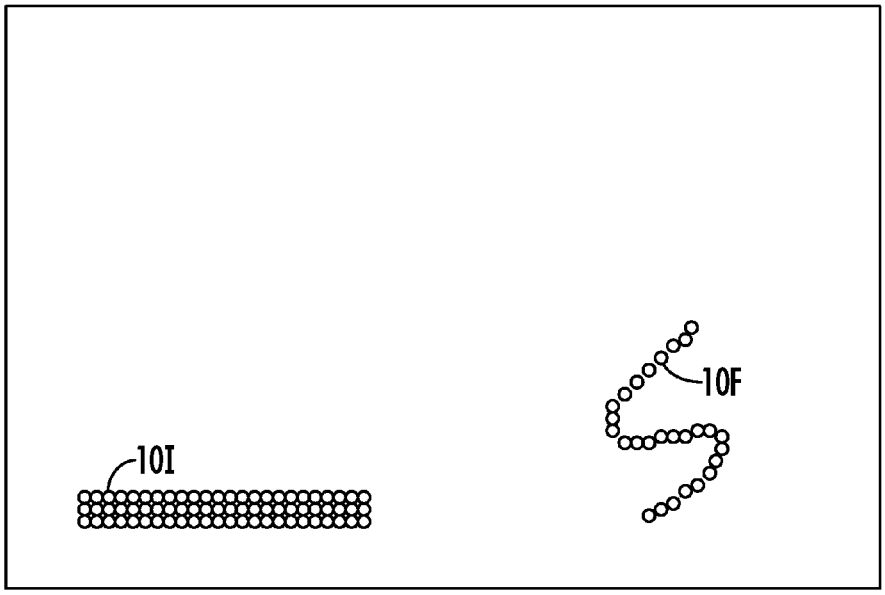
FIG. 16 is a schematic plan view representative of the elongated narrow objects which have been identified by the data processing represented in FIGS. 6-15.

The filtering done in FIG. 15 results in a filtered image as shown in FIG. 16 in which the elongated narrow articles 10F and 10I have been identified as the articles of interest to be removed.

Figure 17:
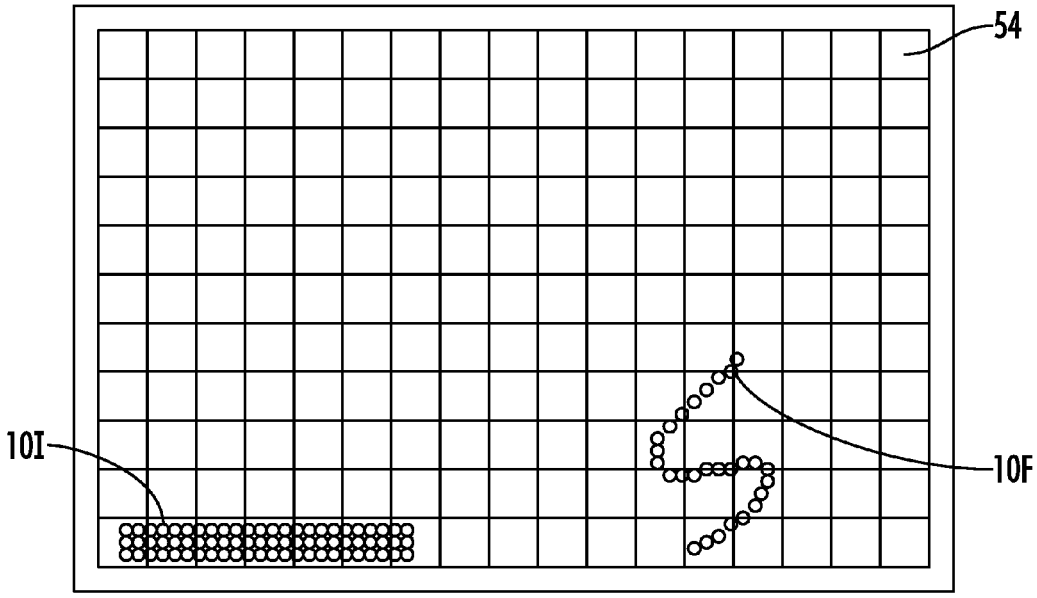
FIG. 17 schematically illustrates the comparison of the image data representative of the articles to be removed, to the locations of jet resolution areas corresponding to the individual air jets 24 used to remove articles from the stream.
Figure 18:
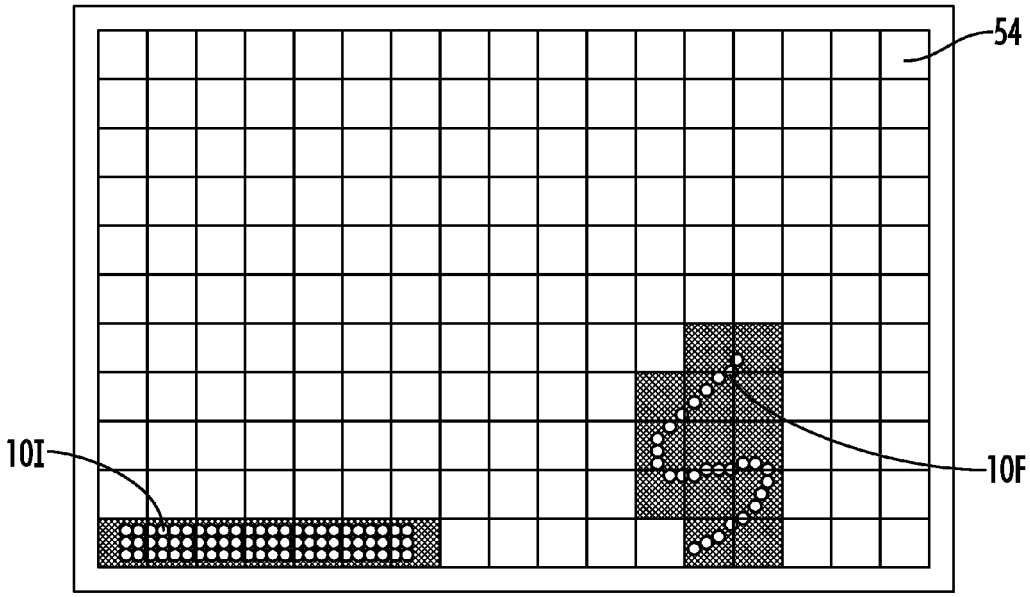
FIG. 18 is a schematic plan view illustrating in shaded form the jet resolution areas to be activated to remove the identified articles from the stream of articles.

Next, as illustrated in FIGS. 17 and 18 it is necessary to correlate the locations of the articles which are to be removed from the stream of articles by comparison of those locations to the corresponding areas within the stream of articles which can be ejected from the stream by the action of one of the air jet ejectors 24.

Each of the air jets 24 may be thought of as having a jet resolution area such as each of the rectangular areas 54 illustrated in FIG. 17. A typical dimension for the area which can be addressed by one of the air jets 24 is on the order of 0.25 inch square. Thus each of these areas 54 which may be referred to as a jet resolution area 54 will be made up of 100 of the pixel areas 48 corresponding to the resolution of the line scan camera 18.

The determination whether to fire each jet is based upon a density of positively indicated pixels within the jet resolution area 54 associated with the jet. This determination can be based upon the presence of one, two or more positively indicated pixels within the jet resolution area. This final filter for determining whether to fire the air jets, provides a sensitivity selector for the user of the equipment so that the degree of separation of wire from the other materials can be adjusted to suit conditions.

Thus, it is desired to actuate each of the air jets 24 at an appropriate time so as to eject the articles present in each of the jet resolution areas 54 corresponding to the location of either of the articles 10F or 10I to be ejected. In FIG. 18, each of the jet resolution areas 54 to be actuated with one of the air jets 24 has been shaded by cross-hatching to show the jet resolution areas which will be actuated to remove the articles 10F and 10I from the stream of articles.

A series of additional examples of the use of the Gabor filter to identify the desired elongated narrow objects is shown in FIGS. 19-22. Again, to create a positive reading, in one embodiment the article must be found to be present along the entire middle bar of the Gabor filter kernel mask, and the article must be absent from the two outside bars of the mask. Also, it is noted that the conditions defining the kernel may be modified such that only some of the pixels along the line of the center bar, for example the end pixels, must have a positive reading in order to conclude that an elongated article is aligned with the center bar; such an approach may reduce the processing time.

Figure 19:
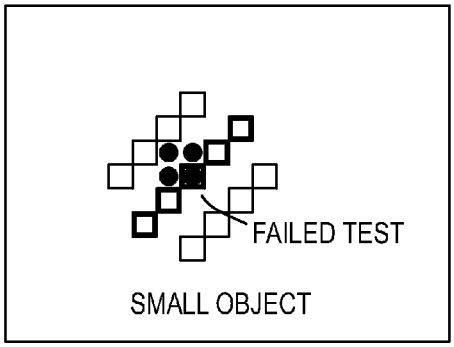
FIG. 19 illustrates a failed test when the Gabor filter kernel is applied to a small object.

In FIG. 19 a relatively small object is shown which is present in the center pixel of interest, but it is not present in the remaining pixels of the middle bar, and thus fails the test and creates a negative reading.

Figure 20:
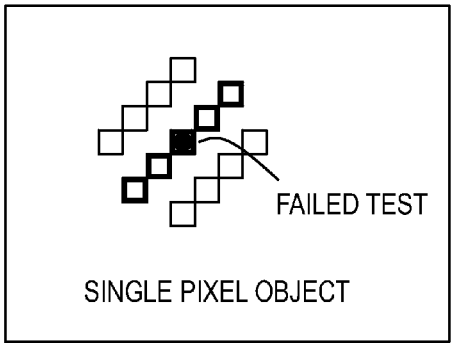
FIG. 20 illustrates a failed test when the Gabor filter kernel is applied to a single pixel object.

Similarly, FIG. 20 illustrates a single pixel sized object lying in the pixel of interest, but again it fails the test and provides a negative reading because all the pixels of the center bar are not covered by the object.

Figure 21:
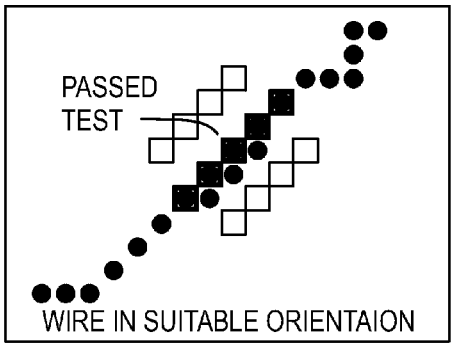
FIG. 21 illustrates a passed test when the Gabor filter kernel is applied to a properly oriented elongated narrow object.

FIG. 21 illustrates the situation where a length of wire is aligned with the center bar and thus passes the test creating a positive reading.

Figure 22:
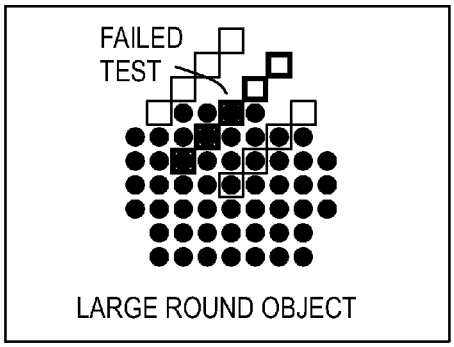
FIG. 22 illustrates a failed test when the Gabor filter kernel is applied to a large round object.
Figure 23A:
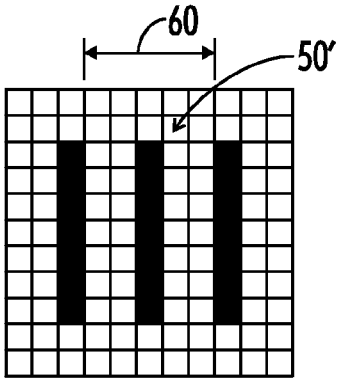
FIGS. 23A-23D comprise a sequential series showing four positions of a modified Gabor filter kernel.
Figure 24A:
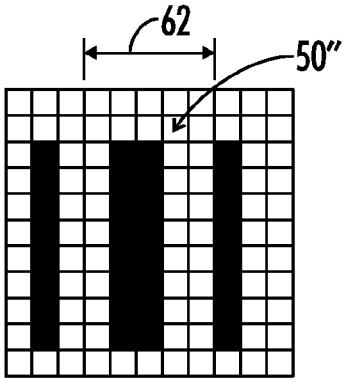
FIGS. 24A-24D comprise a sequential series showing four positions of another modified Gabor filter kernel.
Figure 23B:
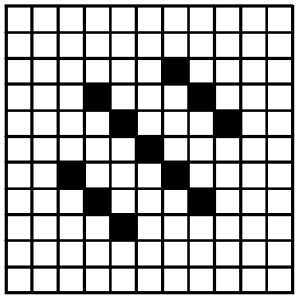
Figure 24B:
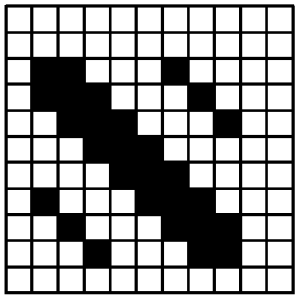
Figure 23C:
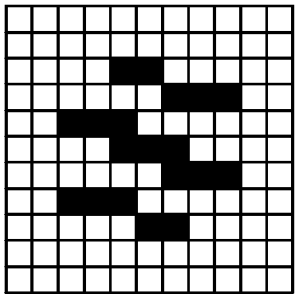
Figure 24C:
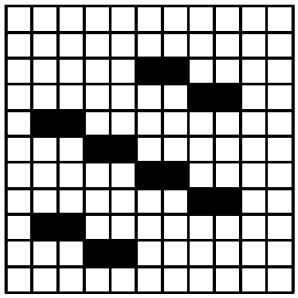
Figure 23D:
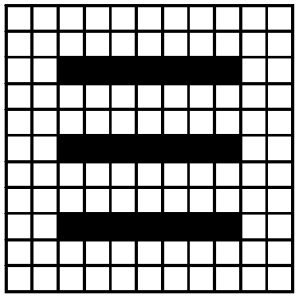
Figure 24D:
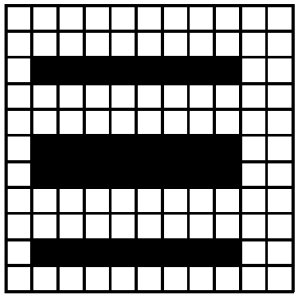

FIG. 22 illustrates the situation where a large round object may overlie many or all of the pixels of the center bar, but because it also overlies some of the pixels of one or both of the outer bars it fails the test and creates a negative reading.

It is also noted that the arrangement of the pixels of the kernel 50 shown in FIGS. 5A-5H may be varied in order to provide a mask to test for wires of different diameters. For example, FIGS. 23A-23D show four sequential rotated positions of a modified kernel 50' in which the spacing between the middle bars and the two outside bars has been increased so that the bars are spaced apart by two pixels rather than the one pixel of FIG. 5A. The mask 50' of FIGS. 23A-23D can have a positive reading for a wire diameter or width 60 up to 5 pixels in width.

Similarly, in FIGS. 24A-24D another alternative kernel 50" uses a thicker middle bar plus a double pixel spacing between the middle bar and the outside bars. The mask 50" of FIGS. 24A-24D can have a positive reading for a wire diameter or width 50" up to 6 pixels. Other mask arrangements can be selected so that wire diameter of any selected size can be detected.

It is noted that the system described is identifying the articles to be separated from the stream of articles solely by their shape as an elongated narrow object. Thus the system will identify wire objects, and it will also identify and sort out other non-wire objects of elongated narrow shape that meet the size parameters determined by the Gabor filter mask. For example, a plastic wire tie in the stream of materials might be identified as an elongated narrow article and sorted with the wire. When sorting electronic waste, however, the vast majority of elongated narrow articles meeting the size parameters will be wire, and thus the system described provides a very efficient technique for separating wire from the mixed electronic waste material.

Other Detectors

In addition to the use of a line scan camera as the optical detector 18, other suitable detectors would include any detector that can give an appropriate bitmap image of the stream of materials.

One alternative is the use of a two-dimensional camera in place of the line scan camera 18, wherein the two-dimensional camera generates an image of a two-dimensional area at each exposure, as contrasted to the single line scan of the line scan camera. Otherwise, the two-dimensional camera will operate in a similar manner to the line scan camera and its data will be processed in a manner similar to that above for the line scan camera detector. Both the line scan camera and the two-dimensional camera may either be a CCD camera or any other suitable camera technology.

Another suitable alternative is a laser scanner which looks at reflectivity. Such a laser scanner is schematically illustrated in FIG. 25 and would include a laser source 100 which scans across the width of the belt 12 in a raster scan manner, and a detector 102 which detects reflected electromagnetic energy from articles on the belt 12.

Figure 25:
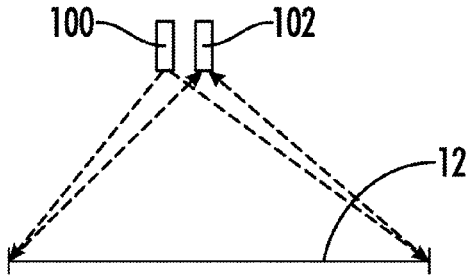
FIG. 25 is a schematic illustration of a reflectivity based laser sensor system.
Figure 26:
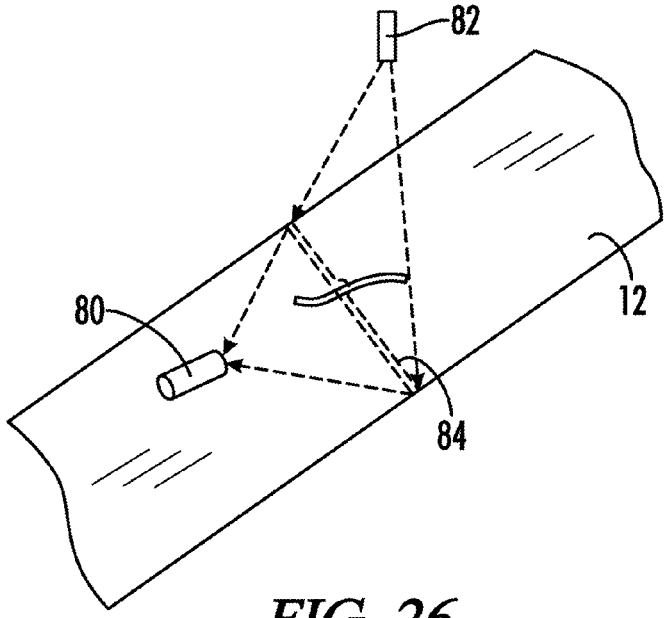
FIG. 26 is a schematic illustration of a laser profile sensor.

Another variation on the laser sensor of FIG. 25 is illustrated in FIG. 26. A laser source 82 creates a line of laser light 84 across the conveyor. A receiver 80 views the line of laser light from an angle such that objects having a height above the conveyor create a discontinuity in the line 84 of laser light as viewed by the receiver. Thus from the appropriate geometry, the dimensions of the article passing across the laser scan line 84 can be determined.

Figure 27:
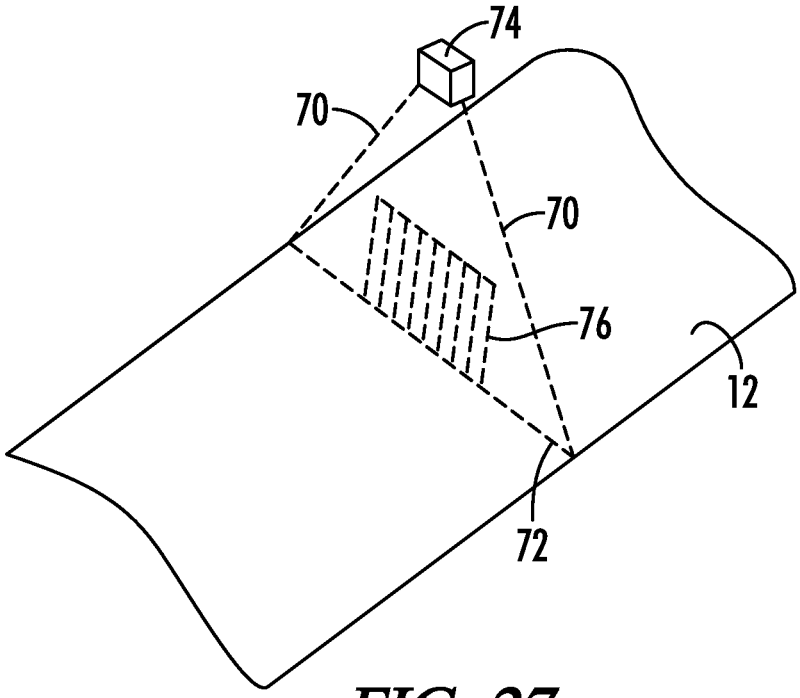
FIG. 27 is a schematic illustration of another laser profile sensor.

Another alternative is a laser profile scanner 74 as shown in FIG. 27 that measures distance via the time of flight of the reflected light. FIG. 27 is a schematic view. The laser profile scanner directs a fan of laser light downward in a fan shape as indicated at 70 to illuminate a line 72 on the conveyor within the detection zone. A sensor contained in the laser profile scanner 74 measures time of flight of reflected light to determine the distance to the various points on the articles on the conveyor. The scanner has an operating range indicated in dashed lines. The operating range is divided into columns 76 as indicated and an internal processor within the scanner evaluates the reflected light and detects the height of the surface within each of the columns. Such a scanner can measure the height of articles within each of the columns and also via abrupt changes in height can identify the location of edges of articles. One commercially available scanner that can be used in this context is an LMS100 laser measurement system available from Sick, AG of Waldkrich, Germany.

Another technology which may be used for the sensor is an LED scanner. The LED scanner is oriented and operates in a manner similar to the time of flight laser profile scanner shown in FIG. 27. The LED scanner, however, uses LED light sources instead of laser light sources.

Another technology which may be used for the sensor is the analysis of multiple wavelengths of electromagnetic energy, such as shown for example in the system described in U.S. Patent Application Publication No. 2012/0221142 of Doak, entitled "Sequential Scanning Of Multiple Wavelengths", assigned to the assignee of the present invention, and hereby incorporated herein by reference.

Other Usages of the Sorting System

In addition to use of the system disclosed herein for the sorting of wire from mixed electronic waste, the system may more generally be used to identify and separate any elongated narrow items. For example the system could be used to identify and sort chopsticks or other eating utensils from the waste from a restaurant.

Depending upon the width of the elongated items to be identified, the size of the kernels of the Gabor filter would be revised to correspond to the range of widths to be detected. Otherwise the process of identification would be similar to that described above.

Also, as noted the process described above is capable of identifying elongated narrow articles solely by shape without any reference to color or material composition of the articles. But in the broader aspects of the invention, other characteristics such as color or material composition may be used in combination with the shape data, to identify and sort certain articles.

For example, if the system is used to identify wooden chopsticks, it might be desirable to also examine wavelengths of electromagnetic energy corresponding to the presence of cellulose, so that the wooden chopsticks can be distinguished from similar shape and size plastic straws. Or it might be desired to additionally sort articles based on the color of the articles.

Detection of Other Shapes

Also, by varying the shape of the kernels of the Gabor filter, shapes other than elongated narrow shapes may be detected.

Figure 29:
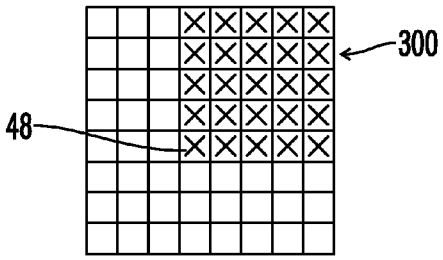
FIG. 29 is a schematic illustration of a kernel shaped for identification of 90 degree corners.

For example, as shown in FIG. 29, the kernel may be in a square shape to detect the 90 degree corners of boxes or other rectangular articles. Such a corner shaped kernel 300 would be rotated similarly to the elongated kernel 50 to identify a pixel 48 at which the apex of such a 90 degree corner shape is located.

Figure 30:
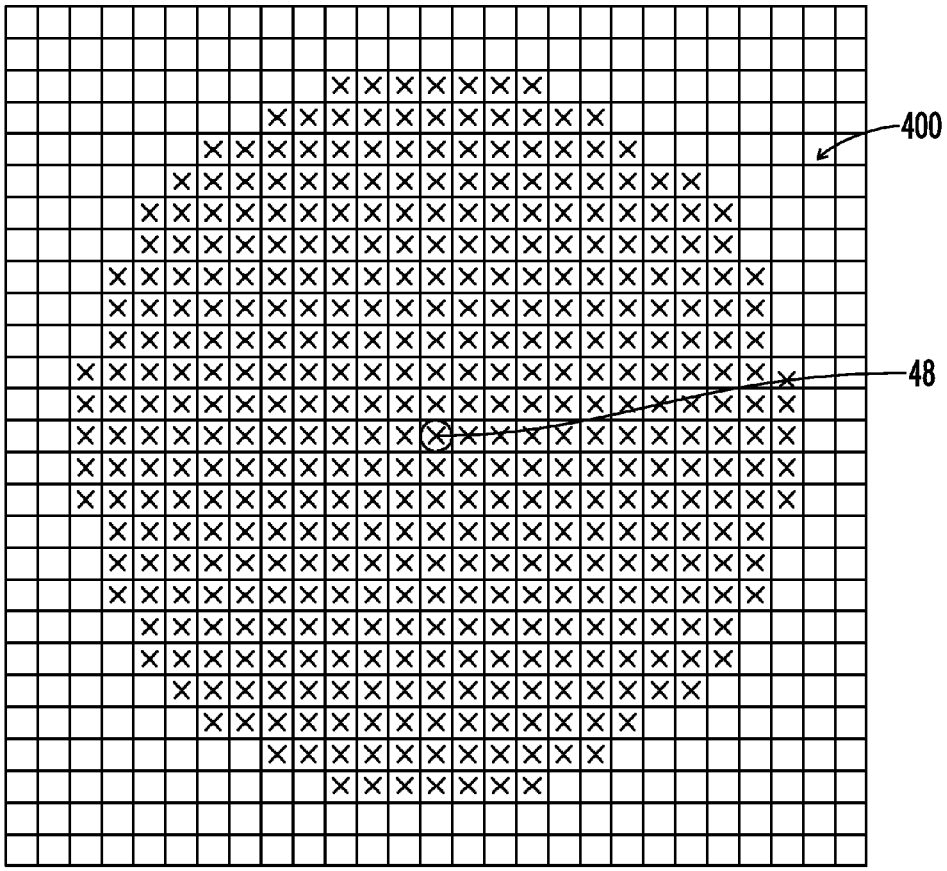
FIG. 30 is a schematic illustration of a kernel shaped for identification a circle shape, such as a coin.

Another example, as shown in FIG. 30, is the detection of circular shapes, for example to detect and sort coins. In that example the kernel set would be a series of approximately circular masks 400, centered on a pixel of interest 48. Instead of rotating the circles, each kernel would be a different size of circle.

Thus, although there have been described particular embodiments of the present invention of new and useful Optical Wire Sorting, it is not intended that such references be construed as limitations upon the scope of this invention except as set forth in the following claims.

What is claimed is:

1. A method of sorting elongated narrow articles from a stream of articles, comprising:

(a) receiving at an optical detector electromagnetic energy from the stream of articles as the articles move through an inspection zone and generating image data representative of the stream of articles;

(b) identifying from the image data locations of articles having an elongated narrow shape solely by shape without any reference to color or material composition of the articles; and (c) separating the articles identified in step (b) from the stream of articles.

2. The method of claim 1, wherein the elongated narrow articles include wire.

3. The method of claim 1, wherein:

in step (a) the optical detector includes a line scan camera.

4. The method of claim 1, wherein:

step (b) further includes using a Gabor filter to identify the articles having an elongated narrow shape.

5. The method of claim 1, wherein step (b) further comprises:

defining a plurality of image areas within an image of the stream of articles; and comparing each of the image areas to a rotating sequence of filter kernels, each filter kernel including a plurality of parallel bars, each filter kernel being rotated relative to an adjacent filter kernel in the sequence.

6. The method of claim 5, wherein:

each of the image areas includes a plurality of adjacent lines of image data recorded by the optical detector.

7. The method of claim 5, wherein:

each of the image areas includes a plurality of pixels; and step (b) includes examining each pixel, and determining for each pixel whether there is a positive indication that an article having an elongated narrow shape lies across the pixel.

8. The method of claim 7, wherein step (c) includes:

deflecting articles from the stream of articles using an air jet having a jet resolution area; and determining whether to fire each jet based upon a density of positively indicated pixels within the jet resolution area.

9. The method of claim 5, wherein:

each of the image areas has a maximum dimension in a range of from ⅛ inch to ½ inch.

10. The method of claim 5, wherein:

each of the image areas has a maximum dimension no greater than ½ inch.

11. The method of claim 5, wherein each of the image areas is square.

12. The method of claim 5, wherein each of the image areas comprises eight rows of eight pixels.

13. The method of claim 1, wherein:

step (b) includes identifying elongated narrow articles having a narrow dimension in a range of from about 0.010 inch to about 0.300 inch.

14. The method of claim 1, wherein:

step (b) includes identifying elongated narrow articles having a maximum narrow dimension of no greater than about 0.300 inch.

15. A system for identifying elongated narrow items in a stream of items moving along a path through an inspection zone and for separating the elongated narrow items from the stream of items, the system comprising:

an array of ejectors arranged transversely across the path, the ejectors being constructed to eject selected items from the stream of items;

a detector arranged to scan the inspection zone transversely across the path; and a controller operably connected to the detector to receive input signals from the detector, the controller being operably connected to the array of ejectors to send control signals to the ejectors, the controller being configured to identify by the shape of the items any elongated narrow items having a maximum width and having a length greater than the maximum width, the maximum width being no greater than about 0.300 inch.

16. The system of claim 15, wherein the elongated narrow items include wire.

17. The system of claim 15, wherein the maximum width is no greater than about 0.250 inch.

18. The system of claim 15, wherein the detector includes a line scan camera.

19. The system of claim 15, wherein:

the controller includes control logic using a Gabor filter to identify the elongated narrow items.

20. The system of claim 15, wherein:

the controller includes control logic configured to define a plurality of image areas making up an image of the stream of items, and to compare each of the image areas to a rotating sequence of filter kernels, each filter kernel including a plurality of parallel bars, each filter kernel being rotated relative to an adjacent filter kernel in the sequence.

21. The system of claim 20, wherein:

each of the image areas includes a plurality of adjacent lines of scan data from the detector, each line corresponding to a portion of a scan by the detector transversely across the path of the stream of items.

22. The system of claim 20, wherein:

each of the image areas has a maximum dimension in a range of from about ⅛ inch to about ½ inch.

23. The system of claim 20, wherein each of the image areas is square.

24. The system of claim 20, wherein each of the image areas comprises eight rows of eight pixels.

25. The system of claim 20, wherein:

each of the image areas includes a plurality of pixels; and the control logic is configured to determine for each pixel whether there is a positive indication that an article having an elongated narrow shape lies across the pixel.

26. The system of claim 15, wherein:

the controller is configured to identify the elongated narrow items without regard to color of the items.

27. The system of claim 15, wherein:

the controller is configured to identify the elongated narrow items without regard to material composition of the items.

28. A method of sorting articles by shape from a stream of articles, comprising:

(a) receiving at an optical detector electromagnetic energy from the stream of articles as the articles move through an inspection zone and generating image data representative of the stream of articles;

(b) identifying from the image data by shape of the articles locations of articles having a selected shape; and (c) separating the articles identified in step (b) from the stream of articles.

29. The method of claim 28, wherein the selected shape is an elongated narrow shape.

30. The method of claim 28, wherein the selected shape is a circular shape.

31. The method of claim 28, wherein the selected shape is a 90 degree corner shape.

* * * * *